US006834773B2

(12) United States Patent
Wu

(10) Patent No.: US 6,834,773 B2
(45) Date of Patent: Dec. 28, 2004

(54) TISSUE DISPENSER

(76) Inventor: Charles Wu, 1469 Abajo Dr., Monterey Park, CA (US) 91754

( * ) Notice: Subject to any disclaimer, the term of this patent is extended or adjusted under 35 U.S.C. 154(b) by 103 days.

(21) Appl. No.: 10/151,571

(22) Filed: May 20, 2002

(65) Prior Publication Data

US 2003/0213810 A1 Nov. 20, 2003

(51) Int. Cl.[7] ..... A47K 10/24
(52) U.S. Cl. ..... 221/45; 221/46; 221/63
(58) Field of Search ..... 221/45, 46, 63, 221/286; 222/186

(56) References Cited

U.S. PATENT DOCUMENTS

| | | | | | |
|---|---|---|---|---|---|
| 1,986,256 | A | | 1/1935 | Ellis | |
| 2,024,884 | A | | 12/1935 | Schlegel | |
| 2,035,384 | A | | 3/1936 | Hinchliff | |
| 2,252,616 | A | | 8/1941 | Broeren et al. | |
| 2,287,581 | A | * | 6/1942 | Walker | 248/694 |
| 2,432,662 | A | | 12/1947 | Gardner | |
| 3,352,449 | A | | 11/1967 | Jackson | |
| 3,507,312 | A | | 4/1970 | Peterson | |
| 4,047,550 | A | | 9/1977 | Scholz | |
| 4,514,995 | A | | 5/1985 | Curtis et al. | |
| 4,570,820 | A | * | 2/1986 | Murphy | 221/34 |
| 4,967,988 | A | | 11/1990 | Nguyen | |
| 5,123,566 | A | * | 6/1992 | Lage et al. | 221/46 |
| 5,165,567 | A | | 11/1992 | Richardson et al. | |
| D332,677 | S | | 1/1993 | Samelson | |
| 5,305,907 | A | | 4/1994 | Richardson et al. | |
| 5,325,986 | A | | 7/1994 | Richardson et al. | |
| 5,553,733 | A | | 9/1996 | Rosenthal | |
| 5,577,635 | A | * | 11/1996 | Block | 221/45 |
| 5,672,186 | A | | 9/1997 | Chesley et al. | |
| D389,682 | S | * | 1/1998 | Gene | D6/518 |
| 6,112,936 | A | * | 9/2000 | Arizmendi | 221/45 |
| 6,196,435 | B1 | | 3/2001 | Wu | |
| 6,364,185 | B2 | * | 4/2002 | Wu | 224/572 |
| 6,561,378 | B1 | * | 5/2003 | Roessler et al. | 221/45 |

* cited by examiner

*Primary Examiner*—Donald P. Walsh
*Assistant Examiner*—Kaitlin Joerger
(74) *Attorney, Agent, or Firm*—Richard E. Bee

(57) ABSTRACT

A tissue dispenser for dispensing facial tissues and the like is described. The tissue dispenser includes a box-like structure having four sides, a top cover and a bottom cover. The top cover has an opening for enabling removal of tissues contained in the boxlike structure. A fastener is provided for releaseably fastening the top cover to at least one of the four sides. An attachment mechanism is secured to the bottom cover for attaching the tissue dispenser to a support surface.

19 Claims, 3 Drawing Sheets

TISSUE DISPENSER

BACKGROUND OF THE INVENTION

This invention relates to tissue dispensers for holding and dispensing tissue materials such as absorbing, wiping, cleaning and polishing tissues, cosmetic and facial tissues, and the like. The tissue dispenser described herein is particularly useful in environments in which the dispenser is subject to noticeable roll, pitch or yaw movements, such as in a moving automobile, boat, aircraft or spacecraft.

It is difficult to hold a tissue dispenser in a stationary position relative to a user in a moving vehicle. The dispenser tends to move about in response to different movements of the vehicle. It is also sometimes difficult to place the dispenser in a location which is in easy reach of the user. There may be no convenient surface near the user upon which the tissue dispenser may be placed.

SUMMARY OF THE INVENTION

A tissue dispenser in accordance with the present invention comprises a box-like structure having four sides, a top cover and a bottom cover, the top cover having an opening for enabling removal of tissues contained in the box-like structure. The tissue dispenser also includes a fastener for releaseably fastening the top cover to at least one of the four sides. The tissue dispenser further includes an attachment mechanism secured to the bottom cover for attaching the tissue dispenser to a support surface.

For a better understanding of the present invention, together with other and further advantages and features thereof, reference is made to the following description taken in connection with the accompanying drawings, the scope of the invention being pointed out in the appended claims.

BRIEF DESCRIPTION OF THE DRAWINGS

Referring to the drawings.

DETAILED DESCRIPTION OF THE ILLUSTRATED EMBODIMENT

Figure 1:
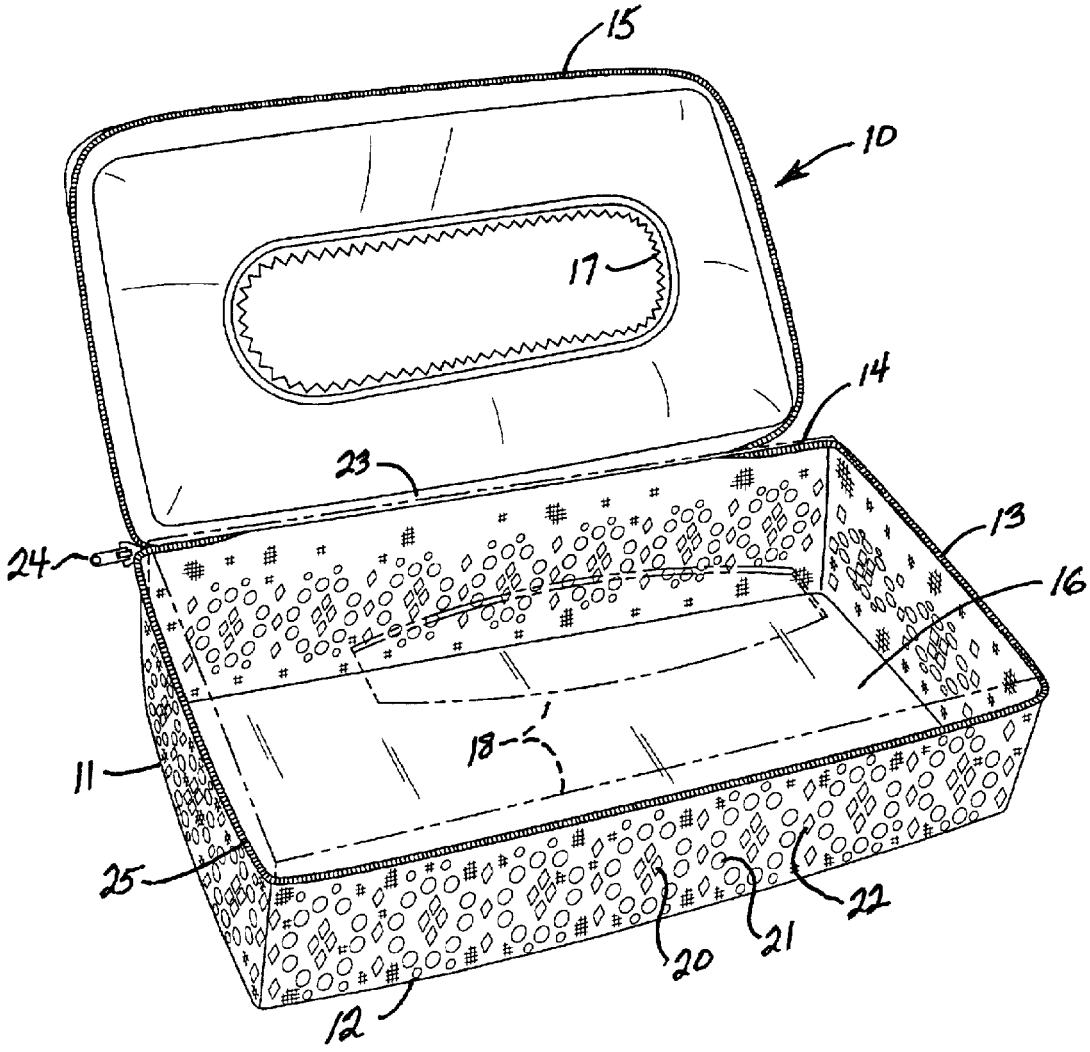
FIG. 1 is a perspective view of a tissue dispenser constructed in accordance with the present invention, with the top cover in an open position to show the interior of a boxlike structure for holding tissues to be dispensed.
Figure 2:
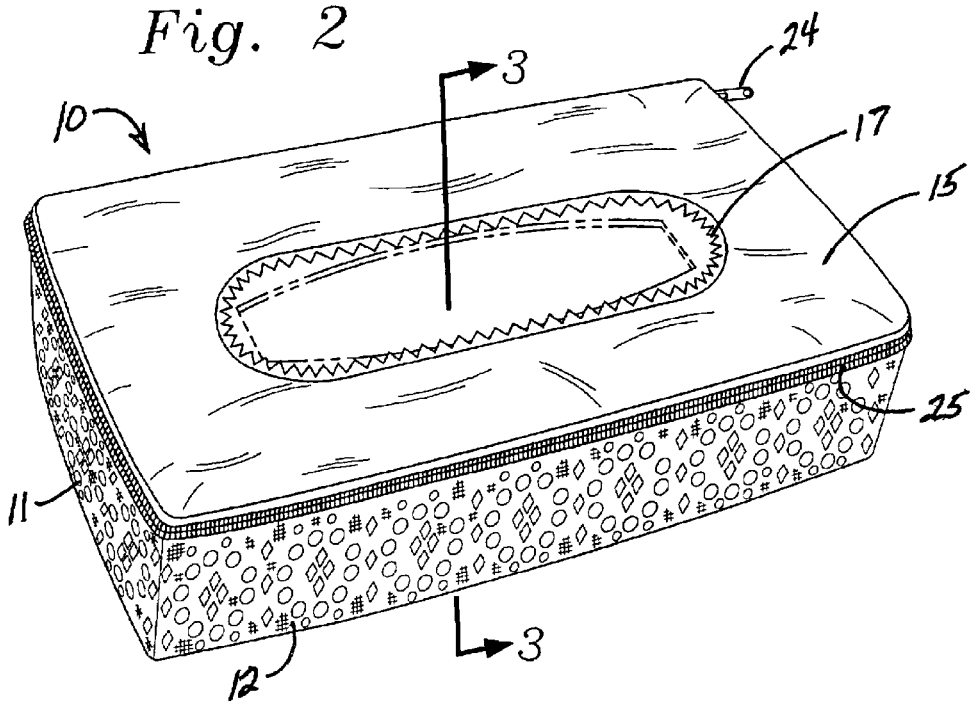
FIG. 2 is a perspective view of the tissue dispenser of FIG. 1, with the top cover in a closed position.

Referring to FIGS. 1 and 2, there is shown a tissue dispenser 10 constructed in accordance with a representative embodiment of the present invention. Tissue dispenser 10 includes a box-like structure having four sides 11—14, a top cover 15 and a bottom cover 16. Top cover 15 has a central opening 17 for enabling removal of tissues contained in the box-like enclosure 11–14. Bottom cover 16 is attached to the lower edges of the four sides 11–14. A commercially available box of tissues is represented by phantom line construction 18 in FIG. 1. The box of tissues 18 is placed inside the four walls 11–14 and is held in place by closure of the top cover 15. FIG. 1 shows top cover 15 in an open position and FIG. 2 shows top cover 15 in a closed position.

Each of the four sides 11–14 has a pattern formed by multiple openings therein. Typical openings are indicated at 20, 21 and 22 in FIG. 1. More particularly, each of the four sides 11–14 is composed of a non-solid net-like material, with the openings (e.g., 20, 21, 22) in the net-like material being located to form a decorative pattern on each of the four sides 11–14.

Figure 3:
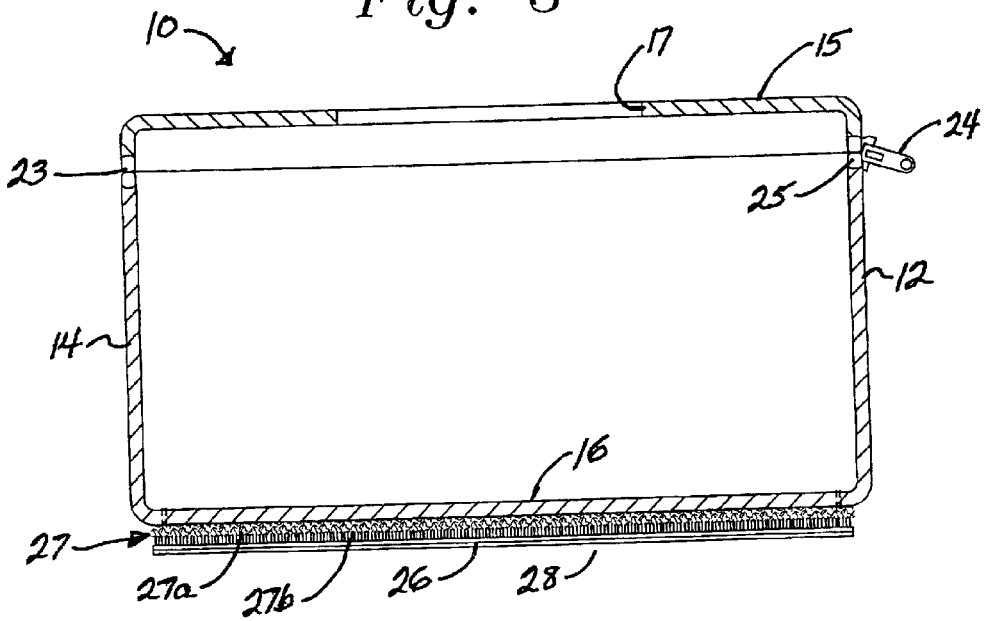
FIG. 3 is a simplified cross-sectional view taken along section line 3—3 of FIG. 2.

FIG. 3 is a simplified cross-sectional view taken along section line 3—3 of the tissue dispenser 10 of FIG. 2. For simplicity, the openings forming the decorative patterns on the sides are not shown in FIG. 3.

Tissue dispenser 10 also includes a hinge portion 23 connecting one side of top cover 15 (the left-hand side in FIG. 3) to an upper portion of side 14. This enables top cover 15 to move in a pivotal manner from the open position of FIG. 1 to the closed position of FIG. 2 and vice versa. This hinge portion 23 may be formed, for example, by an extension of side 14 which extends upwardly and is secured to the edge of top cover 15 by sewing or bonding thereto.

Tissue dispenser 10 further includes a fastener for releaseably fastening at least one of the three non-hinged sides of top cover 18 to its corresponding one of non-hinged sides 11-13. This fastener may take the form of, for example, a zipper 24 having a zipper track 25 which extends around the three non-hinged sides of top cover 15 for releaseably fastening the top cover 15 to the three non-hinged sides 11, 12 and 13. When completely unzipped, the top cover 15 may be pivoted to the open position shown in FIG. 1 to enable placement of a box of tissues 18 inside the tissue dispenser 10. When zipper 24 is completely zipped, the top cover 15 assumes the closed position shown in FIG. 2 and top cover 15 is securely fastened to the unhinged sides 11, 12 and 13. This holds the box of tissues 18 securely in place inside the tissue dispenser 10. Tissues inside the dispenser 10 may thereafter be withdrawn from dispenser 10 by way of opening 17 in top cover 15.

Tissue dispenser 10 also includes an attachment mechanism secured to the exterior of the bottom cover 16 for attaching the tissue dispenser 10 to a support surface. As best seen in FIG. 3, this attachment mechanism may take the form of, for example, a layer of adhesive material 26 which is secured to the bottom cover 16 by a VELCRO fastener 27. VELCRO fastener 27 includes a layer of loop material 27*a* which is bonded to the bottom cover 16 and a layer of hook material 27*b* to the lower surface of which is secured the layer of adhesive material 26. The hooks of hook material 27*b* engage and hook to the loops of loop material 27*a* to secure adhesive layer 26 to the bottom cover 16. A layer of removable cover material 28 is placed over the adhesive layer 26 to prevent premature sticking of the adhesive material 26 to an undesired object or surface.

Figure 4:
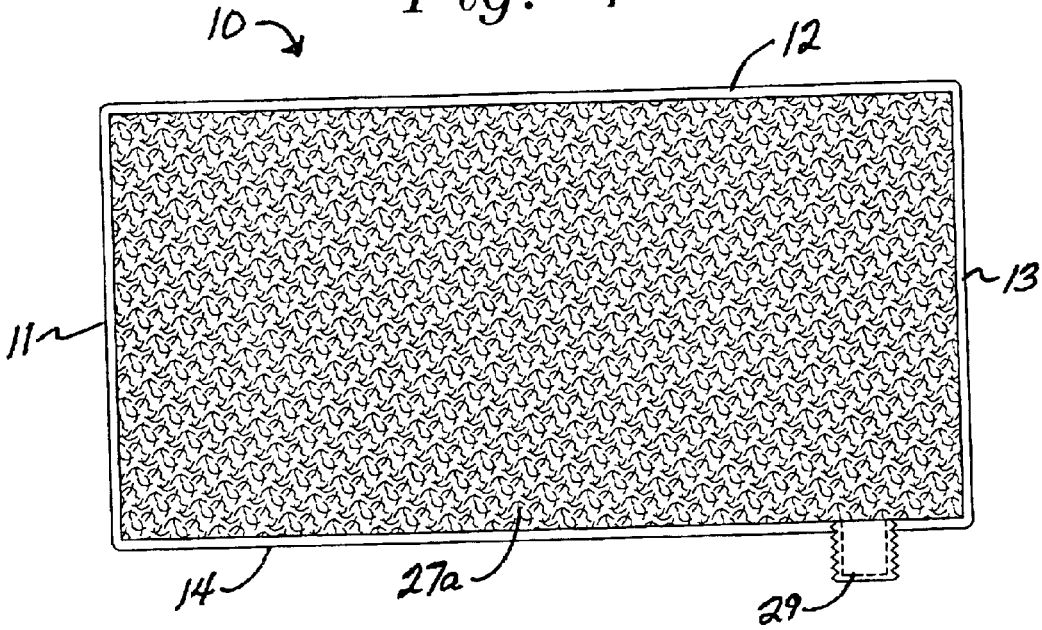
FIG. 4 is a bottom view of the tissue dispenser of FIGS. 1 and 2.

FIG. 4 shows a bottom view of the tissue dispenser 10 of FIGS. 1 and 2 with the hook material 27*b* and the adhesive material 26 removed. What is seen in FIG. 4 is the layer 27*a* of loop-type VELCRO material which covers the bottom cover 16 of the tissue dispenser 10. A finger tab 29 is bonded to the bottom cover 16 for use in separating the 5 layer 27*b* of hook-type VELCRO material from the layer 27*a* of loop-type VELCRO material.

When it is desired to use the tissue dispenser 10 in a moving vehicle, a suitable location within the vehicle is selected and the layer of cover material 28 is removed to expose the adhesive layer 26. The tissue dispenser 10 is then pushed against the selected support surface to cause the adhesive layer 26 to stick to such support surface. Frequently, it will be desired to mount the tissue dispenser 10 within easy reach of the driver of the vehicle. In such case, the tissue dispenser 10 may be mounted on the dashboard, a flat surface of the instrument panel or on the interior ceiling of the vehicle near the driver.

The adhesive nature of the adhesive layer 26 prevents movement of tissue dispense 10 from its selected location during any starting, stopping or turning maneuvers of the vehicle.

A tissue dispenser constructed in accordance with the present invention is not limited to use in a moving vehicle. It may be used in any household, business, hospital or factory location where there is no convenient place to sit a tissue dispenser. A tissue dispenser 10 may be mounted, for example, on a wall near a person's desk.

Figure 5:
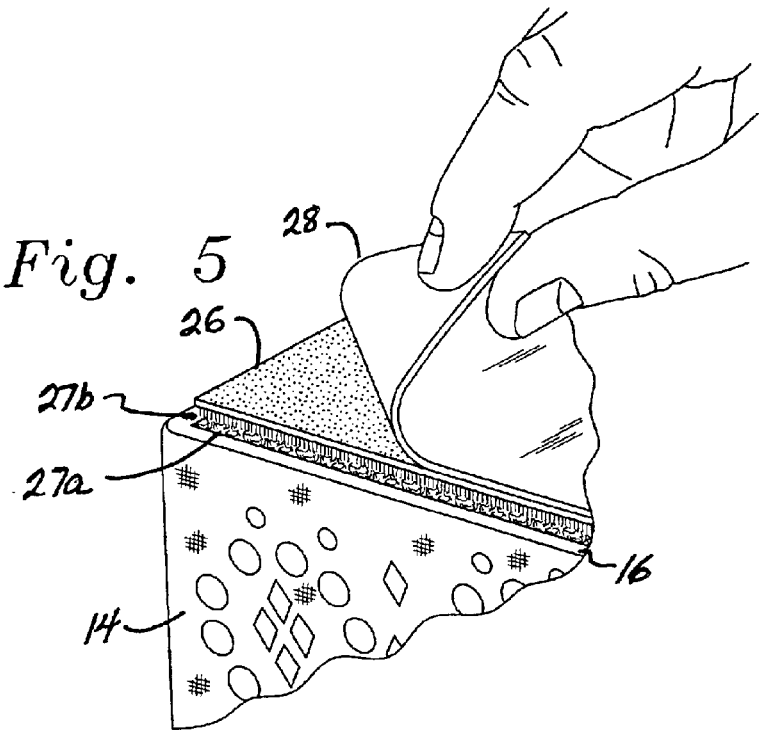
FIG. 5 is an enlarged perspective view of one of the bottom corners of the tissue dispenser of FIGS. 1 and 2.

FIG. 5 shows the removal of the cover material 28 from the adhesive layer 26. The corner of the cover material 28 is pulled up with the fingers and the cover material is peeled off of the adhesive layer 26. The dispenser box 10 is then ready for mounting.

For sake of a pleasing appearance as well as for structural reasons, the exterior of the top cover 15 of tissue dispenser 10 may be made of, for example, a simulated leather material. The net-like side walls 11–14 may be made of, for example, a supple plastic net material. The tissue dispenser of this invention may be made in a variety of sizes and shapes. It may be, for example, of rectangular, square or cubic shape. More importantly, it can be sized and shaped to fit the size and shape of any present-day or future box of tissues that may be marketed.

While there has been described what is at present considered to be a preferred embodiment of this invention, it will be obvious to those skilled in the art that various changes and modifications may be made therein without departing from the invention and it is, therefor, intended to cover all such changes and modifications as come within the true spirit and scope of the invention.

What is claimed is:

1. A tissue dispenser comprising:

a box-like structure having four sides, a top cover and a bottom cover, the top cover having an opening for enabling removal of tissues contained in the box-like structure;

a fastener for releaseably fastening the top cover to at least one of the four sides;

and an attachment mechanism secured to the bottom cover for attaching the tissue dispenser to a support surface;

wherein at least one of the four sides has a pattern formed by multiple openings therein.

2. A tissue dispenser in accordance with claim 1 wherein each of the four sides has a pattern formed by multiple openings therein.

3. A tissue dispenser in accordance claim 1 wherein at least one side is composed of a non-solid net-like material.

4. A tissue dispenser in accordance with claim 3 wherein the openings in the net-like material are located to form a decorative pattern on such side.

5. A tissue dispenser in accordance with claim 1 wherein each of the four sides is composed of a non-solid net-like material.

6. A tissue dispenser in accordance claim 5 wherein the openings in the net-like material are located to form a decorative pattern on each of the four sides.

7. A tissue dispenser comprising:

a box-like structure having four sides, a top cover and a bottom cover, the top cover having an opening for enabling removal of tissues contained in the box-like structure;

a fastener for releaseably fastening the top cover to at least one of the four sides:

and an attachment mechanism secured to the bottom cover for attaching the tissue dispenser to a support surface; wherein the attachment mechanism includes an adhesive member for attaching the tissue dispenser to a support surface.

8. A tissue dispenser in accordance with claim 7 wherein the attachment mechanism includes a layer of adhesive material for attaching the tissue dispenser to a support surface.

9. A tissue dispenser in accordance with claim 8 wherein the attachment mechanism includes a layer of adhesive material which is secured to the bottom cover by a VELCRO fastener.

10. A tissue dispenser comprising:

a structure having four sides to form a box-like enclosure;

a bottom cover attached to the lower edges of the four sides;

a top cover having an opening for enabling removal of tissues contained in the box-like enclosure;

a hinge portion connecting one side of the top cover to an upper portion of one of the four sides;

a fastener for releaseably fastening the upper portion of a least one other of the four sides to the top cover;

and an attachment mechanism secured to the exterior of the bottom cover for attaching the tissue dispenser to a support surface;

wherein at least one of the four sides has a pattern formed by multiple openings therein.

11. A tissue dispenser in accordance with claim 10 wherein each of the four sides has a pattern formed by multiple openings therein.

12. A tissue dispenser in accordance with claim 10 wherein at least one of the four sides is composed of a non-solid net-like material.

13. A tissue dispenser in accordance with claim 12 wherein the openings in the net-like material are located to form a decorative pattern on such side.

14. A tissue dispenser in accordance with claim 10 wherein each of the four sides is composed of a non-solid net-like material.

15. A tissue dispenser in accordance with claim 14 wherein the openings in the net-like material on each of the four sides are located to form a decorative pattern on each of the four sides.

16. A tissue dispenser in accordance with claim 10 wherein the attachment mechanism includes an adhesive member for attaching the tissue dispenser to a support surface.

17. A tissue dispenser in accordance with claim 16 wherein the attachment mechanism includes a layer of adhesive material for attaching the tissue dispenser to a support surface.

18. A tissue dispenser in accordance with claim 16 wherein the attachment mechanism includes a layer of adhesive material which is secured to the bottom cover by a VELCRO fastener.

19. A tissue dispenser comprising:

a structure having four sides shaped to form a box-like enclosure, each of the four sides being composed of a non-solid net-like material with the openings in the net-like material being located to form a decorative pattern;

a bottom cover attached to the lower edges of the four sides;

a top cover having an elongated slot for enabling removal of tissues contained in the box-like enclosure, the exterior of the top cover being composed of a simulated leather material;

a hinge portion connecting one side of the top cover to an upper portion of one of the four sides;

a zipper which extends around the three non-hinged sides of the top cover for releaseably fastening the upper portions of the three non-hinged sides of the box-like enclosure to the top cover;

and an attachment mechanism secured to the exterior of the bottom cover for attaching the tissue dispenser to a support surface, such attachment mechanism comprising a layer of adhesive material which is secured to the bottom cover by a VELCRO fastener.

* * * * *